US006926595B2

(12) United States Patent
Pollak et al.

(10) Patent No.: US 6,926,595 B2
(45) Date of Patent: Aug. 9, 2005

(54) OSCILLATORY DRIVE

(75) Inventors: Roland Pollak, Runkel (DE); Adam Felger, Fellbach (DE)

(73) Assignee: C.&E. Fein GmbH & Co. KG (DE)

( * ) Notice: Subject to any disclaimer, the term of this patent is extended or adjusted under 35 U.S.C. 154(b) by 62 days.

(21) Appl. No.: 10/427,007

(22) Filed: Apr. 30, 2003

(65) Prior Publication Data

US 2003/0220058 A1 Nov. 27, 2003

(30) Foreign Application Priority Data

Apr. 30, 2002 (DE) ..... 102 20 325
Apr. 30, 2002 (DE) ..... 102 20 326

(51) Int. Cl.[7] ..... B24B 7/00; B24B 9/00

(52) U.S. Cl. ..... 451/270; 451/354; 451/356; 451/357

(58) Field of Search ..... 74/22 R, 23, 813 R; 451/270, 344, 351, 354, 356, 357, 441

(56) References Cited

U.S. PATENT DOCUMENTS 4,150,511 A * 4/1979 Khokhulin et al. ..... 451/173
4,972,631 A * 11/1990 Schwar ..... 451/164
5,533,925 A * 7/1996 Sato ..... 451/344
5,993,304 A 11/1999 Eriksson ..... 451/356
6,277,013 B1 * 8/2001 Sasaki et al. ..... 451/360

FOREIGN PATENT DOCUMENTS

| | | |
|---|---|---|
| DE | 3840974 A1 | 6/1990 |
| EP | 0 372 376 B1 | 6/1990 |
| EP | 0 687 529 A1 | 12/1995 |
| WO | WO 97/27027 | 7/1997 |

* cited by examiner

*Primary Examiner*—Timothy V. Eley
(74) *Attorney, Agent, or Firm*—St. Onge Steward Johnston & Reens LLC

(57) ABSTRACT

An oscillatory drive comprising a rotating drive shaft is disclosed. The oscillatory drive is driven by an eccentric element that is coupled via a pivot element to a tool drive shaft arranged at an angle to the drive shaft for oscillatingly driving the tool drive shaft pivoting back and forth about its longitudinal axis. The eccentric element comprises a spherical outer ring which is guided within an at least partially cylindrical inner surface of the pivot element. By spring biasing the free end of the pivot element at both outer sides against the housing, efficiency is improved and vibrations are reduced.

16 Claims, 3 Drawing Sheets

OSCILLATORY DRIVE

This application claims priority of pending German Patent Application Nos. 102 20 326.1 and 102 20 325.3 filed on Apr. 30, 2002.

BACKGROUND OF THE INVENTION

The invention relates to an oscillatory drive comprising a housing within which a drive shaft being rotatingly driven is arranged, an eccentric element driven by the drive shaft, and a tool drive shaft, wherein the eccentric element is coupled by means of a pivot element to a tool drive shaft for oscillatingly driving same about its longitudinal axis.

The invention further relates to a power tool comprising such an oscillatory drive.

Oscillatory drives have been used for many years, in particular, for performing special operations with power tools. For example, oscillatory drives are used in a variety of power tools for performing various grinding and polishing operations, cutting operations, e.g. for cutting out glass panes of windshields, for sawing, e.g. for sawing car body sheets and the like.

To this end relatively high power is necessary that must be transferred to the tool. Herein the efficiency of the oscillatory drive shall be as high as possible, while any noise emission shall be as small as possible. Also any vibrations possibly felt by the user of the tool shall be kept as small as possible.

From EP 0 372 376 A2 various designs of prior art oscillatory drives are known. An oscillatory drive as mentioned at the outset is known from U.S. Pat. No. 5,993,304.

According to the known device, an eccentric is driven by a rotating shaft. On the eccentric, a needle bearing is held that is guided between flat stop surfaces of a pivot lever by means of a crowned outer ring, the pivot lever thereby being oscillatingly driven.

However, these devices have a considerable noise emission and a low efficiency. Also a user may feel vibrations to a considerable extent, depending on the load to which the tool is subjected.

This arrangement suffers from the drawback that there is only a point like contact between the crowned outer ring of the needle bearing and the flat surfaces of the pivot lever affiliated therewith. Thereby, the power of the oscillatory drive is limited. Also a relatively high wear must be taken into account.

SUMMARY OF THE INVENTION

It is an object of the invention to provide an oscillatory drive, which minimizes wear during operation.

It is another object of the invention to provide an oscillatory drive suitable for transmitting relatively high power.

It is still another object of the invention to provide an oscillatory drive, which generates relatively small vibrations, even when operated at relatively high power.

It is yet another object of the invention to disclose an oscillatory drive having relatively high efficiency.

It is another object of the invention to disclose a power tool comprising an improved oscillatory drive.

These and other objects are achieved according to the invention by designing an oscillatory drive as mentioned at the outset such that the eccentric element is guided by means of a spherical outer surface within an at least sectionally cylindrical inner surface of the pivot element.

A line-like contact is provided between the spherical outer surface of the eccentric element and the inner surface of the pivot element. As a result, power transmitted from the eccentric element to the pivot element is dispersed to a larger region, which considerably reduces wear on the device. At the same time, higher power can be transmitted. Also noise generation is considerably reduced, even at high oscillatory frequencies.

By combining a sphere with a cylindrical guide, also the overall system is relatively insensitive with respect to shape errors of its components, such as of the cylindrical inner surface and of the spherical eccentric, as well as insensitive with respect to location errors of its components, in particular of the drive shaft, of the tool drive shaft, of the pivot element and of the eccentric.

In one preferred embodiment of the invention, the eccentric element comprises a cylindrical eccentric section wherein a bearing is received that is guided at the inner surface of the pivot element by means of a spherical outer ring.

By utilizing such a bearing, friction is reduced considerably. At the same time it is made possible to transmit higher power, while wear remains low.

According to another preferred embodiment, the bearing is configured as a needle bearing.

By utilizing a needle bearing considerably higher power can be transmitted when compared to a ball bearing. A needle bearing is relatively insensitive against tilting and offers a high load capacity.

According to still another embodiment of the invention, the drive shaft is arranged perpendicular to the tool drive shaft.

This is the conventional arrangement of the oscillatory drive. However, the oscillatory drive according to the invention also allows arranging the drive shaft with respect to the tool drive shaft at an angle departing there from.

According to an alternative embodiment of the invention the object is achieved by biasing the pivot element at its free end, that cooperates with the eccentric element, on both outer sides against the housing by means of spring elements.

Thereby vibrations are considerably reduced. Also efficiency is considerably increased.

Preferably, the spring elements are configured as pressure spring elements.

While the pivot element oscillates back and forth, the kinetic energy of the pivot element alternately is transformed into potential spring energy (energy of the shape alteration of the spring) and, respectively, after passing through the "dead locations of motion" again is transformed into kinetic energy of the pivot element. Thus, the springs help to decelerate the pivot element towards the dead locations and help to accelerate the pivot element after passing the dead locations. In this way, the necessary forces to be transmitted from the eccentric to the pivot element and the necessary power are reduced. Also noise emission is reduced and the vibrations individually felt by the user of the oscillatory drive are reduced. At the same time, the overall efficiency of the oscillatory drive is improved and any heating of the oscillatory drive is reduced considerably. Thus, also the power consumption of the drive driving the oscillatory drive is considerably reduced.

According to yet another embodiment of the invention, spring receiving surfaces are located at the outer surfaces of the pivot element in the housing sections affiliated therewith, to thereby receive and center the spring elements.

In this way, a safe centering of the spring elements is ensured. Any unwanted additional tensions within the spring elements are thus avoided, whereby design life is improved.

According to still another embodiment of this design, at least one of the spring receiving surfaces comprises a cylindrical protrusion which engages the spring element associated therewith for centering same.

According to an alternative design, at least one of the spring receiving surfaces may comprise a cylindrical recess into which the spring element affiliated therewith engages for centering same.

Both designs ensure a precise centering of the spring elements, whereby a reliable operation is ensured and any wear is reduced.

According to a preferred embodiment, the spring elements may be configured as helical springs or disk springs.

Both spring designs allow for a sufficiently high spring bias which is necessary to reach the desired operation.

According to a preferred embodiment of the invention, the bearing comprises a permanent grease lubrication.

To this end, the outer ring of the bearing may comprise a groove, preferably an annular groove, within which a grease package is received. The grease may communicate directly with roll elements, such as needle rolls, of the bearing.

Thereby a considerably increased design life is reached.

An oscillatory drive according to the invention can, preferably, be used for driving a handheld power tool, in particular a grinding or cutting machine.

It will be understood that the above-mentioned and following features of the invention are not limited to the given combinations, but are applicable in other combinations or taken alone without departing from the scope of the invention.

BRIEF DESCRIPTION OF THE DRAWINGS

Additional features and advantages of the invention will become obvious from the subsequent description of a preferred embodiment with reference to the drawings in which.

DETAILED DESCRIPTION OF THE PREFERRED EMBODIMENT

Figure 1:
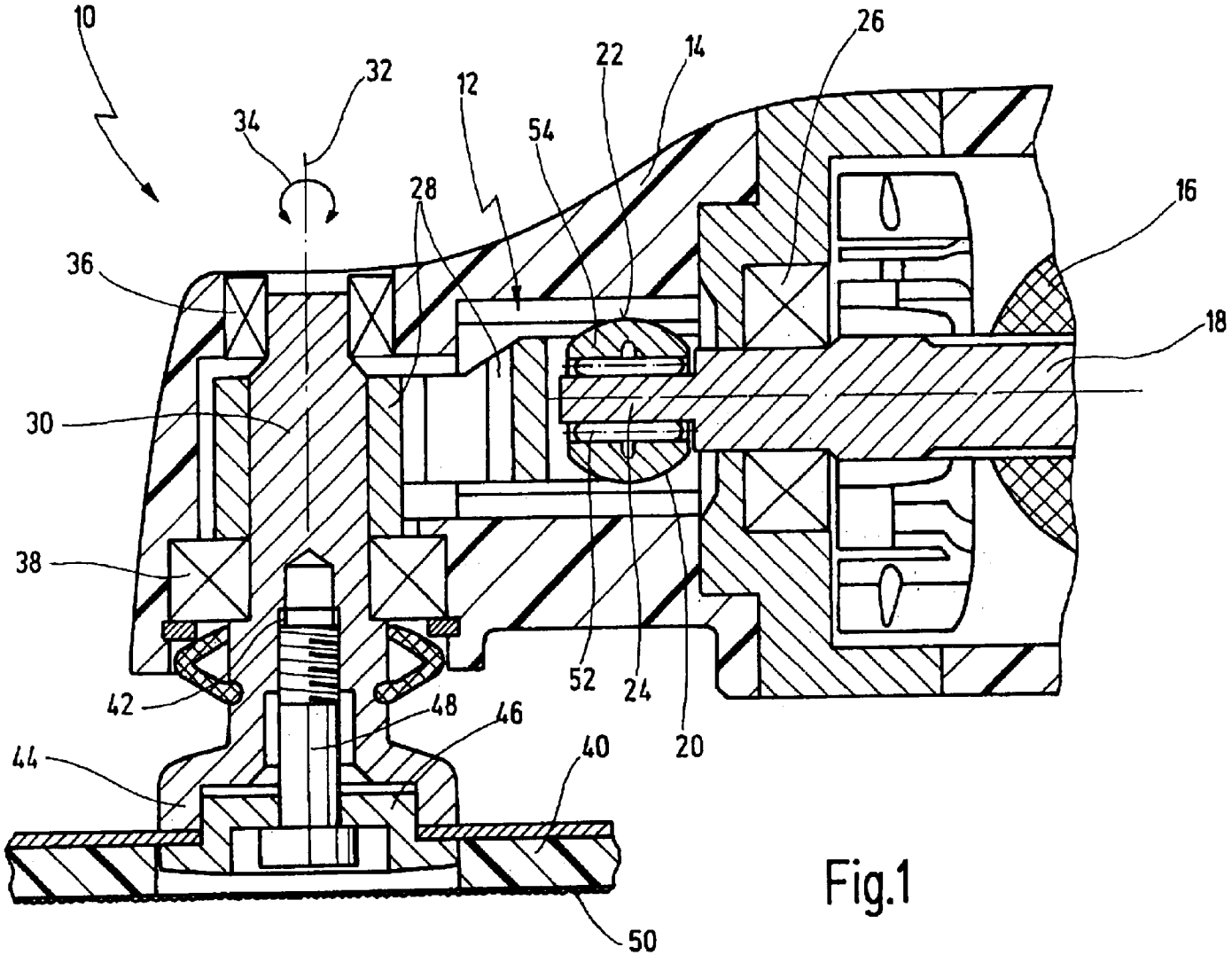
FIG. 1 is a power tool according to the invention, comprising an oscillatory drive, shown in longitudinal section within the region of the oscillatory drive.
Figure 2:
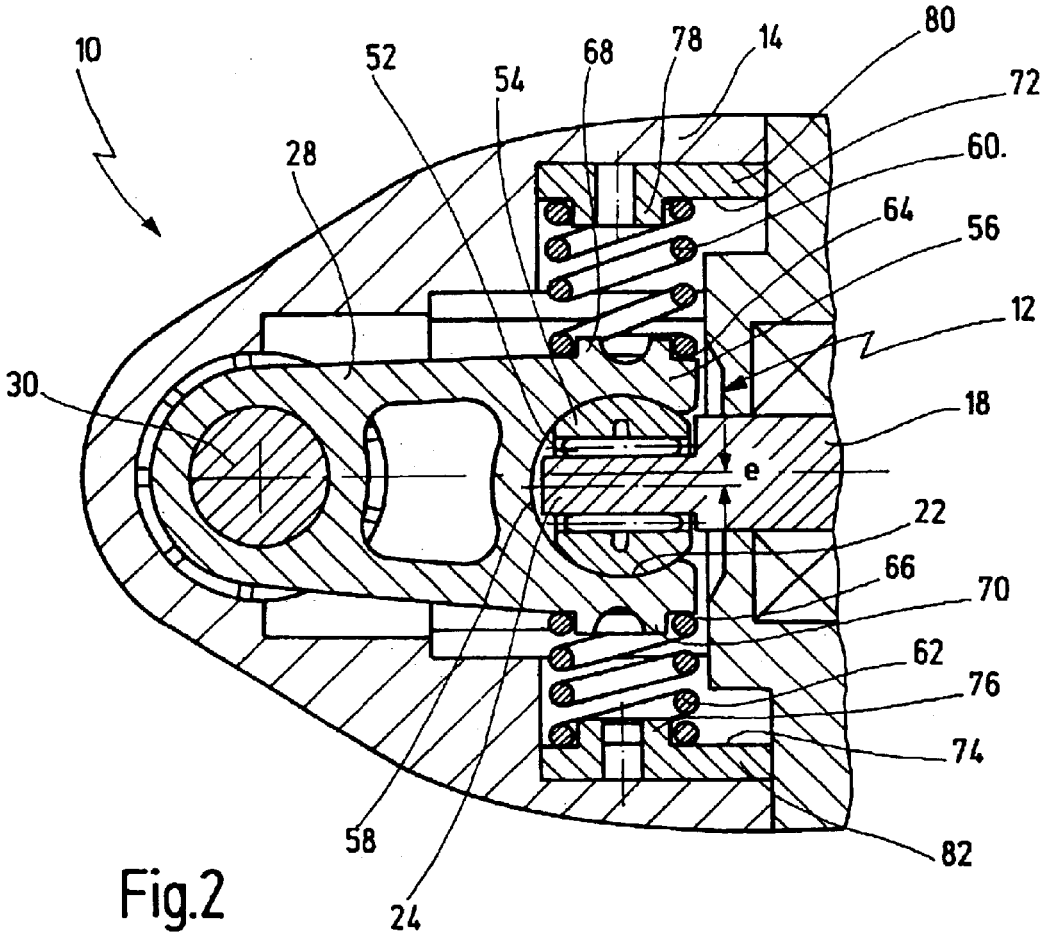
FIG. 2 shows a cross section through the power tool according to FIG. 1, shown in the region of the oscillatory drive.

In FIGS. 1 and 2 a power tool according to the invention is shown and depicted in total with reference numeral 10. It is designed as a handheld power tool, wherein the tool 40 is driven at high frequency of roughly 5,000 to 30,000 oscillations per minute and at a small pivot angle of roughly 0.5 to 7° about the longitudinal axis 32 of a tool drive shaft 30, as shown by double arrow 34. Such a power tool 10 can be utilized for effecting various operations, in particular for grinding or polishing work, for cutting work, for sawing work, and so on.

The power tool 10 comprises an oscillatory drive which is designated in total with reference numeral 12, the oscillatory drive converting a rotating motion of a drive shaft 18 driven by an electric motor 16 into an oscillating motion of the tool drive shaft 30.

In the case shown, the tool drive shaft 30 is arranged perpendicularly with respect to the drive shaft 18.

The oscillatory drive 12 comprises an eccentric element 20 which is held on a cylindrical eccentric section 24 of the drive shaft 18. By means of the eccentric element 20, a pivot element 28 is driven which is rigidly fixed to the tool drive shaft 30 (in FIG. 1, the end of the pivot element 28 in the region of the eccentric element 20 is not located in the drawing plane and can thus not be seen). On the cylindrical eccentric section 24, a needle bearing 52 having axial play is held, the outer ring 54 of which comprises a spherical outer surface 22.

As can be seen from FIG. 2 in more detail, the pivot element 28 at its end 56 opposite the tool drive shaft 30 is formed in the shape of a fork, the inner surface 58 of which is shaped cylindrically, wherein the cylinder axis is located in parallel to the longitudinal axis 32 of the tool drive shaft 30. This cylinder being open toward the drive shaft encompasses the spherical outer ring 54 of the needle bearing 52.

In this way, the eccentricity of the rotating drive motion of the drive shaft 18, in FIG. 2 designated with e, is transformed into a motion of the pivot element 28 which pivots back and forth. Herein, the motion components of the eccentric element 20 which run parallel to the tool drive shaft 30 do not have any effect, since the cylindrical inner surface 58 of the pivot element 28 allows a sliding of the spherical outer ring 54 of the needle bearing 52 along the direction of the cylinder axis. Due to the linear contact between the spherical outer ring 54 and the cylindrical inner surface 58 of the pivot element 28, a particularly good and steady force transmission from the eccentric onto the pivot element is reached. This allows transferring high power at a low wear. In addition, noise emission is small. Since the wear of the oscillatory drive between the spherical outer ring 54 and the cylindrical inner surface 58 during operation of the oscillatory drive increases only at minimal rate and, in addition, is spread relatively evenly, the low noise emission is maintained during total design life of the power tool.

The wear of the spherical outer ring 54 of the needle bearing 52 being small, even and two-dimensional, in general allows for an increased design life of the oscillatory drive when compared to prior art oscillatory drives, even if higher power is to be transmitted.

For reaching a long design life, it is suitable to make the outer ring 54 of the needle bearing 52 and the pivot element 28 from steel materials having hardened surfaces, or from other hard and also sufficiently tough materials (e.g. hard metals, special ceramic materials, etc.). Herein, between the sectional cylindrical inner surface of the pivot element 28 and the spherical outer ring 54, a play (although very small) is set to avoid any fretting of both parts. To this end, also suitable lubrication materials can be utilized. Thus, for instance, the inner surface of the pivot element 28 could be covered by a Teflon® coating.

In addition, in FIG. 1 the holding of the drive shaft 18 within the region following the cylindrical eccentric section 24 by means of a bearing 26 located within the housing 14 can be seen.

In addition, the housing of the tool drive shaft. 30 within the housing 14 by means of bearings 36 and 38 is schematically depicted.

The outer end of the tool drive shaft 30 is formed as a receiving flange 44 for receiving a tool 40. The tool may, for instance, be a triangular shaped grinding disc which is biased in a central region by means of a holding flange 46 against a receiving flange 44, utilizing a tightening screw 48. To this end, the tightening screw 48 is screwed into threads 42 located in the tool drive shaft 30. The outer surface of the tool 40 may, for instance, comprise a Velcro fastening surface 50 for receiving a grinding paper.

Now, with reference to FIGS. 2 and 3, a further important feature of the invention will be described.

Namely, the pivot element 28 in the region of its end 56 opposite the tool drive shaft 30 is biased against the housing 14 on both sides by means of spring elements 60, 62.

In the case shown, both spring elements 60, 62 are designed identically and are formed as strong helical springs having a high spring force. To this end, on both sides of the pivot element 28, a spring receiving surface 64, 66 is provided from which a cylindrical protrusion 68 and 70, respectively, protrudes toward the respective housing wall. This protrusion 68 and 70, respectively, serves for centering the spring element 60 and 62, respectively, at its inner surface.

At the opposite sides, the spring elements 60 and 62, respectively, are held on spring receiving surfaces 72 and 74, respectively. These spring receiving surfaces are formed on inserts 80 and 82, respectively, which are inserted into the housing 14. Again, from the spring receiving surfaces 72 and 74, respectively, cylindrical protrusions 76 and 78, respectively, protrude toward the associated spring element 60 and 62, respectively, for centering the spring elements 60 and 62, respectively.

The pivot element 28 and the inserts 80 and 82, respectively, are preferably made from hardened steel. The spring elements 60, 62 are preferably made from annealed spring steel to keep any wear of the spring elements 60, 62 low, even during continuous operation.

By means of the spring elements 60, 62, the total effectiveness of the conversion of the rotating drive motion of the drive shaft 18 into the oscillating motion of the tool drive shaft 30 is improved. By partially compensating the forces caused by inertia and necessary for accelerating the pivot element 28, the noise emission is reduced and any warming of the oscillatory drive is reduced. Also any vibrations caused by the oscillatory drive are considerably reduced.

When dimensioning the pivot element 28 in the region of its end 56 in a suitable way, the high biasing forces of the spring elements 60, 62 can compress both regions of the pivot element 28 in such a manner that the play between the inner surface 58 and the spherical outer ring 54 of the needle bearing 52 is evenly minimized when wear increases during operation. Thus, the large biasing forces of the spring elements 60, 62 can also help to reduce noise emission of the oscillatory drive 12.

The energy saving and vibration reducing characteristics of the spring system that is formed by the eccentric element 20 cooperating with the pivot element 28 and both tool spring elements 60, 62 is reached by a suitable relatively high bias of the spring elements 60, 62. The high bias forces allow for a continuous trouble-free operation (low self excitation characteristics and high dynamic) of the spring elements 60, 62 from low up to very high oscillatory speeds of the pivot element 28.

Although the spring elements 60, 62 work against each other, within the work area the biased pressure springs function like a tension-pressure-spring operating onto the pivot element and having a doubled spring constant when compared with the single pressure springs. This means that the necessary spring forces and spring constants are reached with considerably less or smaller springs, respectively. Due to the relatively small amplitudes, very high spring constants are necessary, in general, so that the afore-mentioned property of the spring arrangement is advantageous in general.

Figure 3:
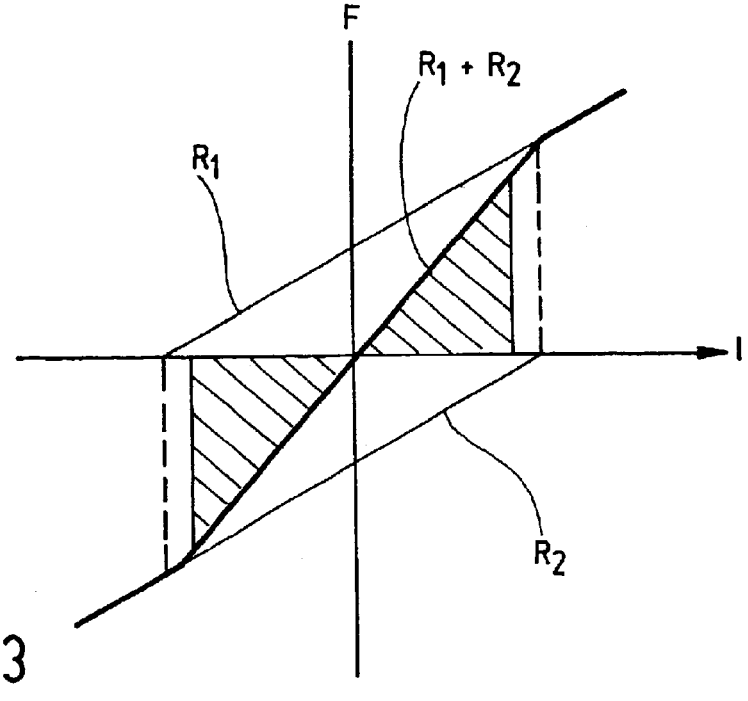
FIG. 3 is a representation of the spring forces over the spring travel for explaining the force relations acting on the spring elements.

These relations can be seen in more detail from FIG. 3.

In FIG. 3, the force F is depicted along the ordinate over the path 1 along the abscise.

In FIG. 3, both spring characteristics are depicted by lines $R_1$ and $R_2$ for both spring elements. The resulting spring characteristic $R_1+R_2$ exhibits a correspondingly enlarged ascent. The work region of both spring elements is shown hatched in FIG. 3.

The bearing 52 configured as the needle bearing naturally should have a design life as high as possible.

Figure 4:
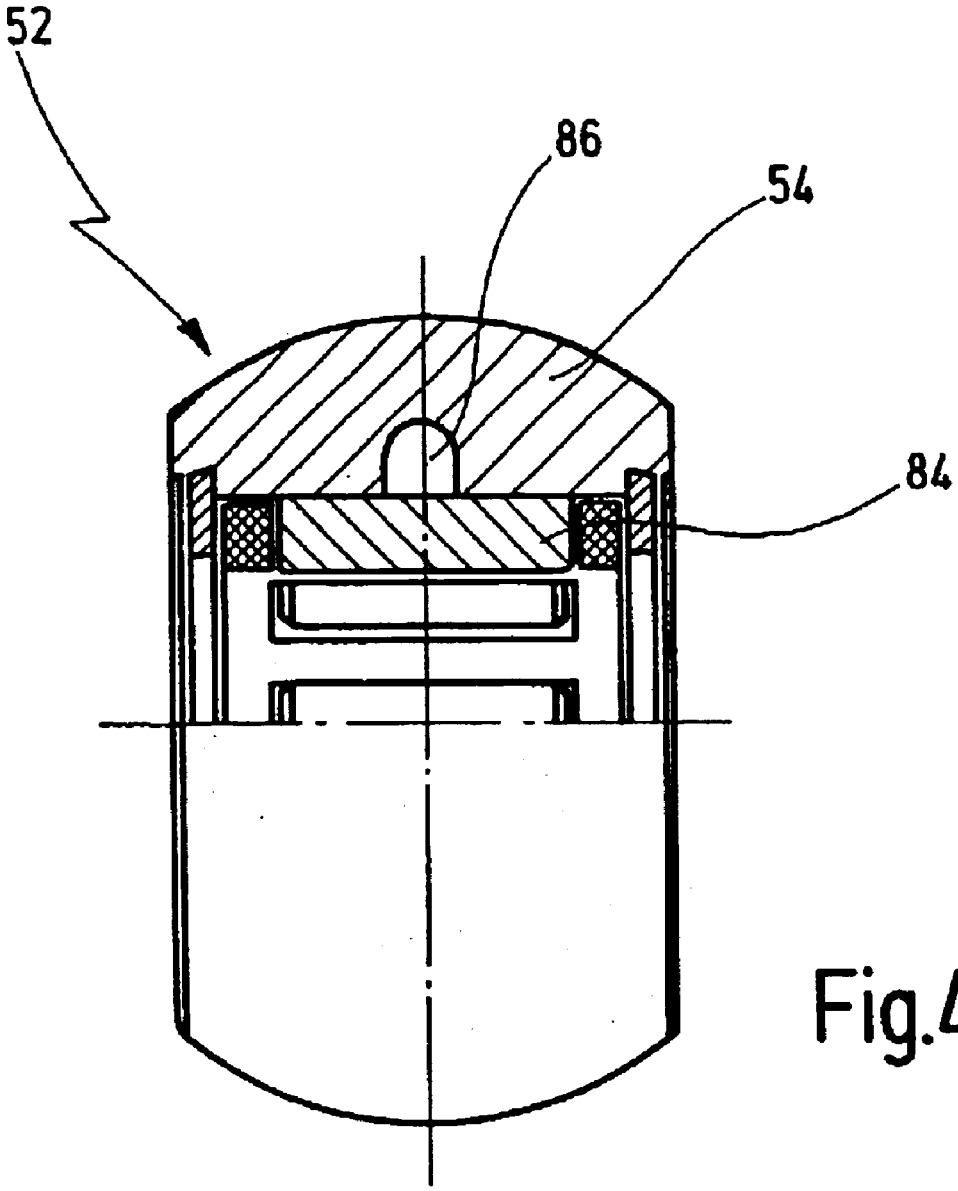
FIG. 4 shows an enlarged representation of the bearing according to FIG. 1 in partially sectioned representation.

To this end, the outer ring of bearing 52 may comprise at its inner surface an annular groove 86, as can be seen from FIG. 4. The recess formed thereby which is open toward the needle rolls 84, is filled with a grease package. In this way, a continuous lubrication of the bearing 52 is reached and a considerably higher design life can be reached when compared with a prior art needle bearing.

What is claimed is:

1. An oscillatory drive comprising a housing;

a tool drive shaft arranged within said housing;

a rotating drive shaft arranged within said housing at an angle to said tool drive shaft;

an eccentric element located on said rotating drive shaft and having a spherical outer surface;

a pivot element having a first end and a second end, said pivot element being fixed on said tool drive shaft at its first end and having a partially cylindrical inner surface at its second end, said partially cylindrical inner surface of said pivot element engaging said spherical outer surface of said eccentric element for oscillatingly driving said tool drive shaft pivoting back and forth about a longitudinal axis thereof;

wherein said second end of said pivot element comprises a first outer side facing a first section of said housing and a second outer side opposite said first outer side and facing a second section of said housing;

a first spring held between said first outer side of said pivot element and said first section for biasing said pivot element into a first direction; and a second spring held between said second outer side of said pivot element and said second section for biasing said pivot element into a second direction opposite said first direction.

2. The oscillatory drive of claim 1, wherein said eccentric element further comprises a cylindrical eccentric section whereon a bearing is received, said bearing having a spherical outer ring engaging said inner surface of said pivot element.

3. The oscillatory drive of claim 2, wherein said bearing is configured as a needle bearing.

4. The oscillatory drive of claim 2, wherein said bearing comprises permanent grease lubrication.

5. The oscillatory drive of claim 4, wherein said outer ring of said bearing comprises an annular groove that is filled with grease.

6. The oscillatory drive of claim 1, wherein said drive shaft is arranged perpendicularly with respect to said tool drive shaft.

7. The oscillatory drive of claim 1, wherein said spring elements are configured as pressure spring elements.

8. The oscillatory drive of claim 1, further comprising centering means located between said first side of said pivot element and said first section of said housing and between said second side of said pivot element and said second section of said housing.

9. The oscillatory drive of claim 8, wherein said first section of said housing and said second section of said housing comprise cylindrical protrusions engaging with said first and second spring elements for centering same.

10. The oscillatory drive of claim 8, wherein said first section of said housing and said second section of said housing comprise cylindrical recesses engaging with said first and second spring elements for centering same.

11. The oscillatory drive of claim 1, wherein said spring elements are configured as helical springs.

12. The oscillatory drive of claim 1, wherein said spring elements are configured as disk springs.

13. An oscillatory drive comprising a tool drive shaft;

a rotating drive shaft arranged at an angle to said tool drive shaft;

an eccentric element located on said rotating drive shaft and having a spherical outer surface;

a pivot element having a first end and a second end, said pivot element being fixed on said tool drive shaft at its first end and having a partially cylindrical inner surface at its second end, said partially cylindrical inner surface of said pivot element engaging said spherical outer surface of said eccentric element for oscillatingly driving said tool drive shaft pivoting back and forth about a longitudinal axis thereof.

14. An oscillatory drive comprising a housing;

a tool drive shaft arranged within said housing;

a rotating drive shaft arranged within said housing at an angle to said tool drive shaft;

an eccentric element located on said rotating drive shaft and having a spherical outer surface;

a pivot element having a first end and a second end, said pivot element being fixed on said tool drive shaft at its first end and engaging said eccentric element at its second end for oscillatingly driving said tool drive shaft pivoting back and forth about a longitudinal axis thereof;

wherein said second end of said pivot element comprises a first outer side facing a first section of said housing and a second outer side opposite said first outer side and facing a second section of said housing;

a first spring held between said first outer side of said pivot element and said first section for biasing said pivot element into a first direction; and a second spring held between said second outer side of said pivot element and said second section for biasing said pivot element into a second direction opposite said first direction.

15. A power tool comprising a housing;

an oscillatory drive arranged within said housing for oscillatingly driving a tool drive shaft about a longitudinal axis thereof;

wherein said oscillatory drive comprises a rotating drive shaft arranged at an angle to said tool drive shaft;

an eccentric element located on said rotating drive shaft and having a spherical outer surface;

a pivot element having a first end and a second end, said pivot element being fixed on said tool drive shaft at its first end and having a partially cylindrical inner surface at its second end, said partially cylindrical inner surface of said pivot element engaging said spherical outer surface of said eccentric element for pivoting said tool drive shaft back and forth about said longitudinal axis.

16. A power tool comprising a housing;

an oscillatory drive arranged within said housing for oscillatingly driving a tool drive shaft about a longitudinal axis thereof;

wherein said oscillatory drive comprises a rotating drive shaft arranged within said housing at an angle to said tool drive shaft;

an eccentric element located on said rotating drive shaft and having a spherical outer surface;

a pivot element having a first end and a second end, said pivot element being fixed on said tool drive shaft at its first end and engaging said eccentric element at its second end for pivoting said tool drive shaft back and forth about said longitudinal axis;

wherein said second end of said pivot element comprises a first outer side facing a first section of said housing and a second outer side opposite said first outer side and facing a second section of said housing;

a first spring held between said first outer side of said pivot element and said first section for biasing said pivot element into a first direction; and a second spring held between said second outer side of said pivot element and said second section for biasing said pivot element into a second direction opposite said first direction.

* * * * *